United States Patent [19]

Miller

[11] 4,451,810

[45] May 29, 1984

[54] MAGNETIC TOOL HOLDER

[75] Inventor: Merrill R. Miller, Clarinda, Iowa

[73] Assignee: Lisle Corporation, Clarinda, Iowa

[21] Appl. No.: 464,407

[22] Filed: Feb. 7, 1983

[51] Int. Cl.[3] ..... H01F 7/20

[52] U.S. Cl. ..... 335/285; 248/206.5

[58] Field of Search ..... 335/285, 303, 295, 302, 335/306; 248/206.5

[56] References Cited

U.S. PATENT DOCUMENTS

| | | | |
|---|---|---|---|
| 2,862,752 | 12/1958 | Heppner | 335/285 |
| 2,966,992 | 1/1961 | Dunkelberger et al. | 335/285 |
| 3,228,133 | 1/1966 | Baermann | 335/285 |
| 3,827,021 | 7/1974 | Phelon | 335/285 |

*Primary Examiner*—George Harris

*Attorney, Agent, or Firm*—Allegretti, Newitt, Witcoff & McAndrews, Ltd.

[57] ABSTRACT

An improved magnetic tool holder includes a pair of plates with a magnetic bar sandwiched therebetween and a pair of L-shaped support brackets riveted to the assembly.

2 Claims, 6 Drawing Figures

Fig. 1
(PRIOR ART)
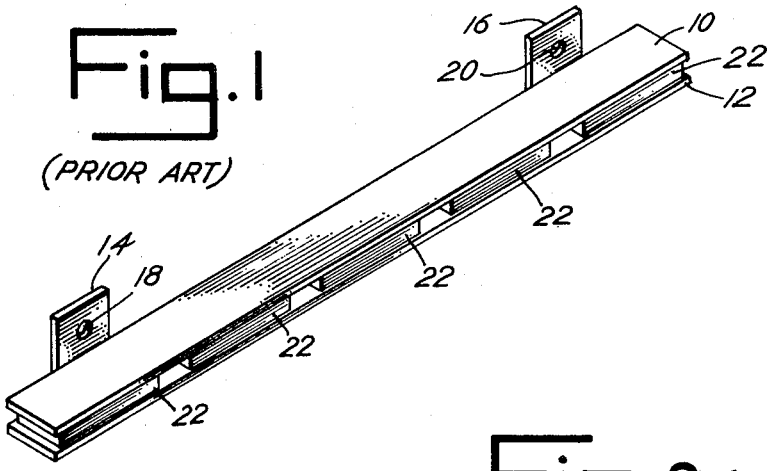
Fig. 2 (PRIOR ART)
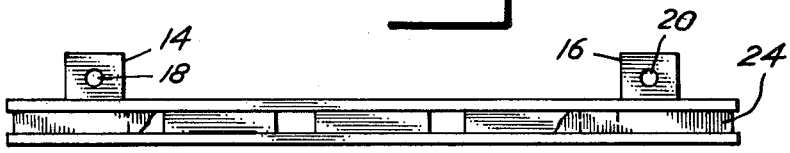
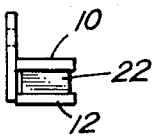
Fig. 3
(PRIOR ART)
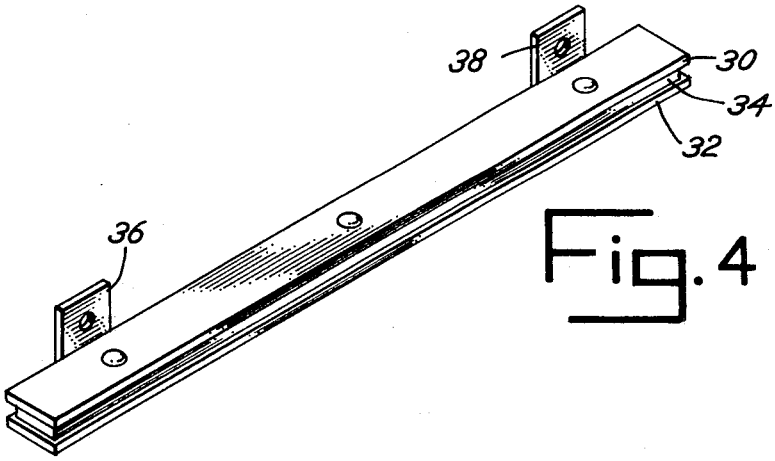
Fig. 4
Fig. 6
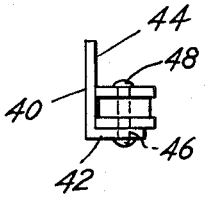
Fig. 5
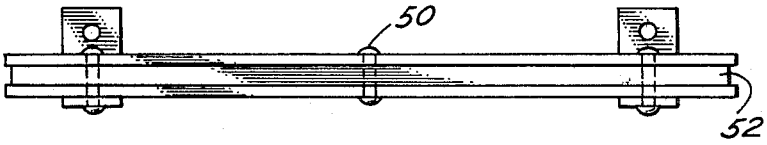

MAGNETIC TOOL HOLDER

BACKGROUND OF THE INVENTION

This invention relates to an improved magnetic tool holder and more particularly to a magnetic tool holder of simplified construction relative to prior known magnetic tool holders.

A known prior art tool holder is comprised of a pair of parallel metal plates with a series of ceramic magnets glued therebetween and a pair of metal holders welded to the back edge of the plates for supporting the holder on a wall or cabinet or the like. This assembly is quite useful and effective for support or holding of tools by means of magnetism. During assembly of this construction, the ceramic magnetic members are maintained in position by means of an adhesive. The plates are maintained with respect to one another in a separated and rigid condition by welded bracket supports. Preferably a layer of tape is fitted over the edges of the ceramic magnets to provide for high visibility of the tool holder.

While the aforesaid construction is very useful, assembly of the holder has various complications associated therewith including the requirement of glueing the ceramic magnet members in position and also the assembly by welding techniques of the plates in a properly spaced fashion for cooperation and holding of the magnets. The present invention contemplates an improved combination of elements which eliminates some of the difficulties associated with the prior art construction particularly the difficulties of assembly. In addition, the construction of the present invention results in a tool holder which has improved strength characteristics.

SUMMARY OF THE INVENTION

Briefly, the present invention comprises an improved magnetic tool holder fabricated from a pair of equally sized, spaced metal plates and a single magnetic bar sandwiched between those plates having dimensions substantially equal to the dimensions of the plates. Two L-shaped bracket members are riveted to these assembled plates and magnetic bar. The magnetic bar is preferably fabricated from a flexible material such as nitrile rubber impregnated with magnetic powder.

Thus, it is an object of the present invention to provide an improved tool holder.

A further object of the present invention is to provide a tool holder which is easy to assembly and manufacture and has a fewer number of parts than known prior art tool holders of similar construction.

Still a further object of the present invention is to provide a tool holder construction which eliminates the need for adhesive bonding during the assembly of the holder and also eliminates the need for welding during the assembly of the holder.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a perspective view of a prior art tool holder;

FIG. 2 is a front elevation of the tool holder of FIG. 1;

FIG. 3 is a side elevation of the tool holder of FIG. 1;

FIG. 4 is a perspective view of the improved tool holder of the present invention;

FIG. 5 is a front elevation of the improved tool holder of FIG. 4; and

FIG. 6 is a side elevation of the tool holder of FIG. 4.

DESCRIPTION OF THE PREFERRED EMBODIMENT

FIGS. 1–3 illustrate a known prior art tool holder. Such a tool holder is fabricated from a top metal plate 10 and a bottom metal plate 12 having equal dimensions and spaced a fixed distance by means of welded brackets 14, 16 positioned along one side edge of the plates 10, 12. The brackets 14, 16 include openings 18, 20, respectively, through which a fastener which be positioned to attach the tool holder of FIGS. 1–3 to a surface such as a wall or cabinet door. The plates 10, 12 are precisely spaced so that ceramic magnetic members 22 may be positioned between the plates 10, 12. The ceramic magnetic members are distributed evenly from one another between the plates 10, 12 and are held in position by means of adhesive. Once the components described are assembled, it is preferable to position a high visibility tape strip 24 over the sides of the ceramic members 22 to enhance the visibility of the tool holder and also to improve its appearance since the ceramic elements are spaced from one another and provide wide gaps which may be considered unsightly.

The improvement of the present invention comprises the tool holder illustrated in FIGS. 4–6. Referring to these figures, a pair of plates 30, 32 are positioned on opposite sides of a magnetic bar 34. No adhesive is used to fasten the components together. A pair of L-shaped brackets 36, 38 having a support leg 40 and a fastening leg 42 are provided for the holder. The support leg 40 is positioned along one edge of plates 30, 32 and also adjacent an edge of bar 34 as shown in FIG. 6. The support leg 40 has a length which is greater than the thickness of the sandwiched plates 30, 32 and bar 34. The support leg 40 also includes opening 44 through which a fastener may be positioned to hold the holder on a wall or the like.

The fastening leg 42 also includes an opening 46. The fastening leg 42 has a length dimension slightly less than the width of the bar 32. A rivet 48 is positioned through matched openings in the plates 30, 34 and bar 34 and through the opening 46 in the leg 42 to hold the assembly together. It is possible to use a single rivet 48 associated with each bracket member 36, 38 as depicted. In the preferred embodiment, however, an additional rivet 50 is used to maintain the plates 30, 32 and bar 34 in assembled condition.

With the assembly of the present invention, fastening by welding and adhesive is eliminated. Moreover, a single rivet is utilized to assemble each bracket 36, 38 with the plates 30, 32 and bar 34. In a preferred embodiment of the invention, the edge of the bar 34 is covered by a highly visible tape or coating 52. The coating may be affixed in any desired pattern. The coating constitutes primarily a decorative feature or a feature designating origin of the product. It may be functional to the extent that it provides high visibility and thus renders the position of the tool holder easy to locate.

Note that the width and length dimensions of the bar 34 are slightly less than the identical dimensions of the plates 30, 32. Of course, the particular shape of the plates 30, 32 and comparable shape of the bar 34 may be adjusted in any desired fashion depending upon need.

The material utilized for the bar 34 is particularly important with respect to the invention. The specific material used to fabricate the bar is a magnetic powder such as barrium ferrite impregnated in a rubber or synthetic rubber such as nitrile rubber, for example, so that the bar is flexible. This is in contrast with prior art magnetic elements which are hard and brittle. Typical flexible magnetic elements are available from 3M Company under the tradename "Plastiform", The Electrodyne Company under the tradename "Plastalloy" and B. F. Goodrich Company under the tradename "Koroseal".

While there has been set forth a preferred embodiment of the invention, it is to be understood that the invention is to be limited only by the following claims and their equivalents.

What is claimed is:

1. An improved magnetic tool holder comprising, in combination:

a pair of equally sized, generally rectangular, metal plates;

a single magnetic bar having longitudinal and width dimensions slightly less than the corresponding dimensions of the plates, said bar comprised of a flexible material impregnated with a magnetic powder material;

at least two L-shaped bracket members having a support leg longer than the cumulative thickness of the plates and bar and a fastening leg having a length slightly less than the width of the plates; and at least two fasteners connected entirely through a series of aligned openings in an assembly stack of the plates with the bar therebetween and the fastening leg against one plate and with the support leg positioned against the longitudinal aligned edges of the plates and bar, each support leg spaced laterally from the other, each support leg extending transversely from the assembly stack and including an opening for attachment and support of the holder, one fastener being associated with each bracket member to maintain the holder in assembled condition.

2. The improved holder of claim 1 including a highly visible coating layer about at least a portion of the exposed side surface of the bar.

* * * * *